US009217287B2

(12) United States Patent
Comeaux et al.

(10) Patent No.: US 9,217,287 B2
(45) Date of Patent: Dec. 22, 2015

(54) SYSTEMS AND METHODS FOR DRILLING BOREHOLES WITH NONCIRCULAR OR VARIABLE CROSS-SECTIONS

(75) Inventors: Blaine C. Comeaux, Spring, TX (US); Ronald J. Dirksen, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 489 days.

(21) Appl. No.: 13/564,338

(22) Filed: Aug. 1, 2012

(65) Prior Publication Data

US 2013/0032406 A1 Feb. 7, 2013

Related U.S. Application Data

(60) Provisional application No. 61/514,333, filed on Aug. 2, 2011.

(51) Int. Cl.

| | |
|---|---|
| ***E21B 7/00*** | (2006.01) |
| ***E21C 37/18*** | (2006.01) |
| ***E21B 7/15*** | (2006.01) |
| *E21B 10/56* | (2006.01) |

(52) U.S. Cl.

CPC . *E21B 7/001* (2013.01); *E21B 7/15* (2013.01); *E21C 37/18* (2013.01); *E21B 2010/562* (2013.01)

(58) Field of Classification Search

CPC ... E21B 10/36; E21B 10/02; E21B 2010/562; E21B 25/04

USPC ..... 175/416, 398, 16, 91, 402

See application file for complete search history.

(56) References Cited

U.S. PATENT DOCUMENTS

| | | | | |
|---|---|---|---|---|
| 2,121,914 | A * | 6/1938 | Hokanson | 175/418 |
| 3,878,905 | A * | 4/1975 | Schaumann | 175/383 |
| 4,741,405 | A * | 5/1988 | Moeny et al. | 175/16 |
| 5,289,889 | A * | 3/1994 | Gearhart et al. | 175/325.5 |
| 5,671,816 | A * | 9/1997 | Tibbitts | 175/101 |

(Continued)

FOREIGN PATENT DOCUMENTS

| | | |
|---|---|---|
| WO | WO-2008/003092 | 1/2008 |
| WO | WO-2010/027866 | 3/2010 |

OTHER PUBLICATIONS

Dirksen, Ronald J., "Systems and Methods for Drilling Boreholes with Noncircular or Variable Cross-Sections", U.S. Appl. No. 61/514,333, filed Aug. 2, 2011, 6 pgs.

*Primary Examiner* — David Bagnell
*Assistant Examiner* — Tara Schimpf
(74) *Attorney, Agent, or Firm* — Krueger Iselin LLP; Scott H. Brown

(57) ABSTRACT

In a pulsed-electric drilling system, a nonrotating bit is given a noncircular shape to drill a correspondingly-shaped borehole, e.g., triangular, rectangular, polygonal, oval, or a more complex shape. Some embodiments employ a reconfigurable bit that deploys extensions as needed to dynamically vary the cross-section of the borehole at selected locations. In this fashion, a driller is able to create borehole with a preferred cross-sectional shape to, e.g., drill the smallest possible hole while simultaneously providing additional clearance for equipment or instrumentation, additional surface area for well inflow, channels for improved borehole cleaning, teeth for improved cementing, reduced contact area to reduce drag on the drillstring, or any other benefits achievable by customizing the borehole cross-section.

18 Claims, 3 Drawing Sheets

(56) References Cited

U.S. PATENT DOCUMENTS

| | | | | |
|---|---|---|---|---|
| 5,738,178 | A * | 4/1998 | Williams et al. | 175/61 |
| 8,100,197 | B2 * | 1/2012 | Warnicki et al. | 175/57 |
| 2006/0048972 | A1 * | 3/2006 | Odell et al. | 175/57 |
| 2009/0038853 | A1 * | 2/2009 | Zamfes | 175/58 |
| 2012/0165997 | A1 | 6/2012 | Lewis et al. | |
| 2012/0169841 | A1 | 7/2012 | Chemali et al. | |
| 2012/0186816 | A1 | 7/2012 | Dirksen et al. | |
| 2012/0228882 | A1 | 9/2012 | Dirksen | |
| 2013/0008647 | A1 | 1/2013 | Dirksen et al. | |
| 2013/0032397 | A1 | 2/2013 | Dirksen | |
| 2013/0032398 | A1 | 2/2013 | Dirksen | |
| 2013/0032399 | A1 | 2/2013 | Dirksen | |
| 2013/0032400 | A1 | 2/2013 | Dirksen | |
| 2013/0032404 | A1 | 2/2013 | Donderici et al. | |

* cited by examiner

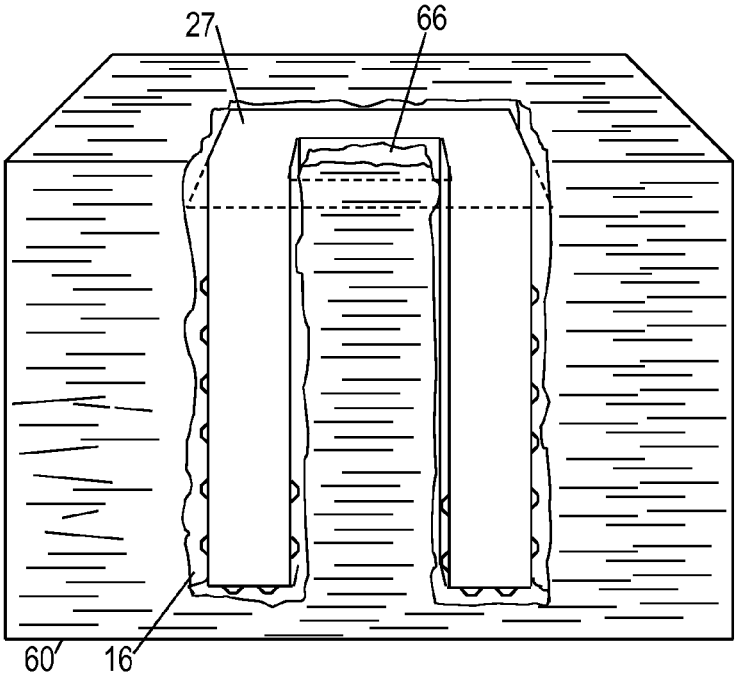
FIG. 3
FIG. 4
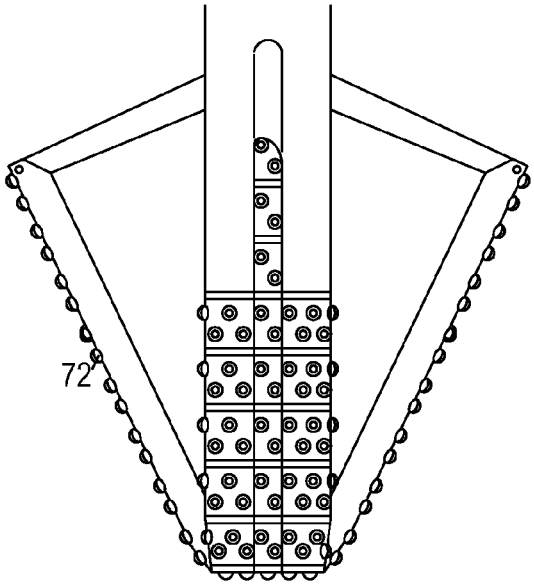

FIG. 5A
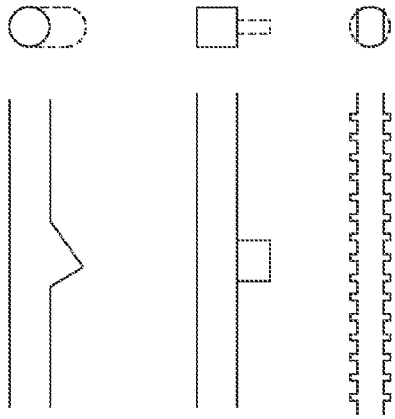
FIG. 5C
FIG. 5B
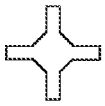
FIG. 5D
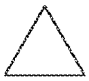
FIG. 5E
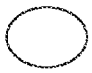
FIG. 5F
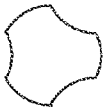
FIG. 5G
FIG. 6
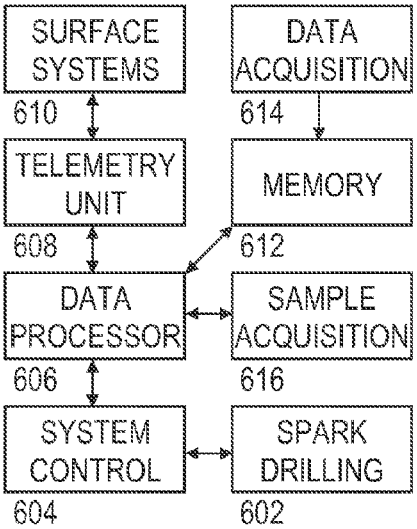
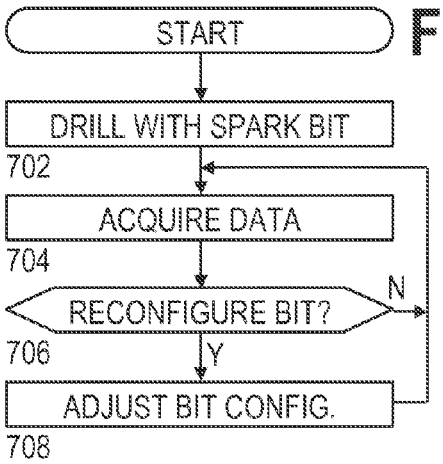
FIG. 7

SYSTEMS AND METHODS FOR DRILLING BOREHOLES WITH NONCIRCULAR OR VARIABLE CROSS-SECTIONS

RELATED APPLICATIONS

The present application claims priority to U.S. Application 61/514,333, titled "Systems and methods for drilling boreholes with noncircular or variable cross-sections" and filed Aug. 2, 2011 by Blaine Comeaux and Ron Dirksen. The foregoing application is hereby incorporated herein by reference.

BACKGROUND

There have been recent efforts to develop drilling techniques that do not require physically cutting and scraping away material to form the borehole. Particularly relevant to the present disclosure are pulsed electric drilling systems that employ high energy sparks to pulverize the formation material and thereby enable it to be cleared from the path of the drilling assembly. Illustrative examples of such systems are disclosed in: U.S. Pat. No. 4,741,405, titled "Focused Shock Spark Discharge Drill Using Multiple Electrodes" by Moeny and Small; WO 2008/003092, titled "Portable and directional electrocrushing bit" by Moeny; and WO 2010/027866, titled "Pulsed electric rock drilling apparatus with non-rotating bit and directional control" by Moeny. Each of these references is incorporated herein by reference.

Generally speaking, the disclosed drilling systems employ a bit having multiple electrodes immersed in a highly resistive drilling fluid at the bottom of a borehole. The systems generate multiple sparks per second using a specified excitation current profile that causes a transient spark to form and arc through the most conducting portion of the borehole floor. The arc causes that portion of the borehole floor to disintegrate or fragment and be swept away by the flow of drilling fluid. As the most conductive portions of the borehole floor are removed, subsequent sparks naturally seek the next most conductive portion.

To date all oilfield drilling systems known to the authors create circular boreholes. While satisfactory for many purposes, there are situations in which this limitation creates inefficiencies in the drilling process, e.g., by requiring a much larger volume of material to be removed from the borehole than is truly necessary.

BRIEF DESCRIPTION OF THE DRAWINGS

Accordingly, there are disclosed herein in the drawings and detailed description specific embodiments of systems and methods for drilling boreholes with noncircular or variable cross-sections. In the drawings:

FIG. 3 shows an illustrative coring bit having a square cross-section.

FIG. 4 shows an illustrative drill bit having a finned cross-section.

FIGS. 5A-5C show illustrative variable cross-section boreholes.

FIGS. 5D-5G show illustrative boreholes with noncircular cross-sections.

FIG. 6 is a function-block diagram of illustrative tool electronics.

FIG. 7 is a flowchart of an illustrative drilling method.

Figure 1:
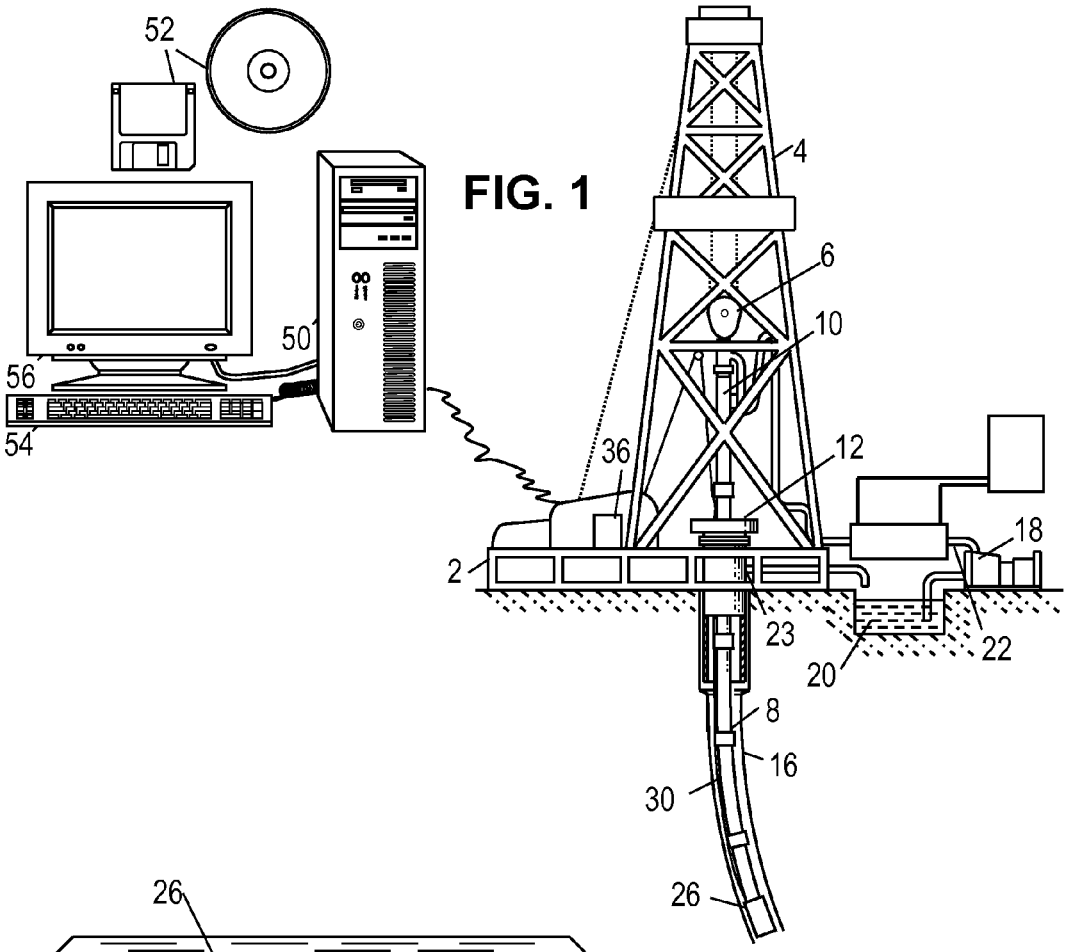
FIG. 1 shows an illustrative pulsed-electric drilling environment.

It should be understood, however, that the specific embodiments given in the drawings and detailed description do not limit the disclosure. On the contrary, they provide the foundation for one of ordinary skill to discern the alternative forms, equivalents, and modifications that are encompassed in the scope of the appended claims.

DETAILED DESCRIPTION

Systems and methods for drilling boreholes with noncircular cross-sections and/or variable cross-sections. The disclosed systems employ a pulsed electric drilling system such as that disclosed by Moeny in the above-identified references. Because such systems do not require drill bit rotation, the bits can be given a noncircular shape to drill boreholes with corresponding shapes, e.g., triangular, rectangular, polygonal, oval, or more complex shapes including crosses, star-shapes, and finned. (As used herein, a fin is a relatively thin, flat projection from a central region.) Further, the bits can be made configurable to extend electrodes or deploy arms or other extensions to change the cross-section of the borehole at selected locations.

In this fashion, a driller is able to create borehole in subterraneous earth or at surface with a preferred cross-sectional shape. The desire to create a specific shape of hole in a downhole well can be driven by the need to locate special equipment that does not conform to a circular hole shape or that would require an excessively large circular hole to provide sufficient clearance around the equipment. For example, devices for downhole remote sensing, monitoring, and actuation (commonly referred to as "Smartwell" technology) may be included in a casing string or attached to the outside of the casing string, creating a "bulge" on one edge of an otherwise circular cross-section. Such technology may benefit from additional clearance along one side of casing to accommodate the bulge. By limiting the amount of rock that must be removed to only what is required, the drilling costs and time should be reduced, as well as the amount of cuttings that must be disposed off.

Other potential advantages to a noncircular hole shape include: reduced wall contact with the drillstring (and hence less friction), channels for more effective flushing of debris from the borehole, increased effective permeability in production zones, and improved cementing performance. These and other competitive advantages may arise from having the flexibility to drill a shape other than a circle for whatever purposes the user desires.

The disclosed embodiments can be best understood in the context of their environment. Accordingly, FIG. 1 shows a drilling platform 2 supports a derrick 4 having a traveling block 6 for raising and lowering a drill string 8. A drill bit 26 is powered via a wireline cable 30 to extend borehole 16. Power to the bit is provided by a power generator and power conditioning and delivery systems to convert the generated power into multi-kilovolt DC pulsed power required for the system. This would likely be done in several steps, with high voltage cabling being provided between the different stages of the power-conditioning system. The power circuits will generate heat and will likely be cooled during their operation to sustain operation for extended periods.

Recirculation equipment 18 pumps drilling fluid from a retention pit 20 through a feed pipe 22 to kelly 10, downhole through the interior of drill string 8, through orifices in drill bit 26, back to the surface via the annulus around drill string 8, through a blowout preventer and along a return pipe 23 into the pit 20. The drilling fluid transports cuttings from the borehole into the pit 20, cools the bit, and aids in maintaining the borehole integrity. A telemetry interface 36 provides communication between a surface control and monitoring system 50 and the electronics for driving bit 26. A user can interact with the control and monitoring system via a user interface having an input device 54 and an output device 56. Software on computer readable storage media 52 configures the operation of the control and monitoring system.

Figure 2:
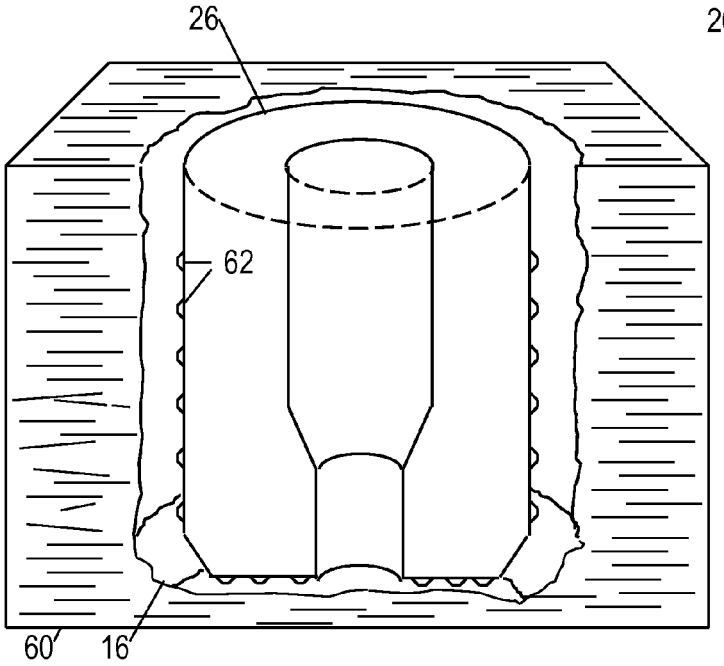
FIG. 2 is a detail view of an illustrative drill bit.

FIG. 2 shows a close-up view of an illustrative formation 60 being penetrated by drill bit 26. Electrodes 62 on the face of the bit provide electric discharges to form the borehole 16. A high-permittivity, high-resistivity drilling fluid flows from the bore of the drill string through one or more ports in the bit to pass around the electrodes and return along the annular space around the drillstring. The fluid serves to communicate the electrical discharges to the formation and to cool the bit and clear away the debris.

Though the bit is shown as having a circular transverse cross-section in FIG. 2, this is not a requirement. Bits that are noncircular and/or reconfigurable can be used as part of a system designed to destroy rock by transmitting very high current into the rock via electrodes mounted on the face of a drill bit structure. The electric arcs propagate into the rock ahead of the electrode and back to the grounding elements on the drill bit. The arrangement of the electrodes and grounding elements in a given pattern will determine the shape of the hole that is created.

For example, FIG. 3 shows a coring bit 27 having a square (inner and outer) cross-section to cut a square borehole 16 while simultaneously obtaining a square core 66. In addition to providing cores that are easier to analyze, the illustrated configuration enables the relative orientation between the core and the borehole to be determined, maintained, and employed in later operations. For example, the illustrated configuration offers an opportunity for identifying rock grain orientations relative to the borehole and employing that knowledge for increased completion effectiveness using directional completion techniques (e.g., oriented projectiles or oriented fracturing jets).

The coring bit 27 can be designed to periodically cut the core for transport to the surface. In some embodiments, the cutting is performed when the bit detects a change in rock morphology, e.g., based on at-bit resistivity measurements. Many coring bits exist and can be used as a guide for the implementation of a noncircular pulsed-electric coring bit. This bit design can also be employed for sidewall coring operations.

By mounting the electrodes and grounding elements on movable components, the shape of the hole created can be changed on-the-fly, i.e., without tripping out of the well. For example, the downhole assembly may be equipped with a mechanism for extending the electrodes laterally into the side wall, either a few inches for collecting a core of the formations or for generating a drainage hole of significant length (e.g., tens to thousands of feet) into the formations at a desired depth. The mechanism for extending the electrodes may also be utilized to enlarge the borehole over a specific desirable interval or multiple intervals or over the entire length of borehole drilled.

FIG. 4 shows an illustrative bit with extendable arms 72 to cut slots along the borehole wall. The arms can be retracted for regions of the borehole where slots are not desired. The electrodes provide pulverization of the formation without requiring a substantial force, thereby making it possible to provide configurable drill bits without requiring an extremely rugged design. Many other extension configurations are known (e.g., for sidewall coring and fluid sampling tools) and may be suitable for incorporation into a pulsed electric drilling bit.

FIGS. 5A-5C show a variety of illustrative borehole configurations having variable cross-sections. FIG. 5A shows a borehole with a primarily circular cross section, but with a cavity cut into the sidewall in preparation for a multilateral diverter. This cavity can be created with a pulsed-electric drilling electrodes on a semi-cylindrical extension hinged at its top edge to the bottomhole assembly. As the extension is pressed outwardly from the bottomhole assembly, the electric arcs pulverize the material and permit it to be flushed from the cavity. The extension can then be returned to a flush position in the bottomhole assembly, leaving a pre-cut cavity that makes it easy to land a deployable diverter without requiring a large excavation around the perimeter of the borehole, as is commonly done today.

FIG. 5B shows an illustrative borehole with a square cross-section and a square side cavity, which may be useful for a side-pocket type of Smart Well instrument, or may be used for position indexing. The drill string may be configured to cut such a cavity at a precise distance from, e.g., the bottom of the borehole, a formation boundary, or an anchored assembly. The cavity can then be detected by subsequently lowered instruments or even used as a secure landing for anchoring such instruments.

FIG. 5C shows a nominally circular borehole with a series of teeth along opposite sides of the borehole. The drill bit can cut such teeth by periodically deploying a set of electrodes to cut the teeth to the desired shape. Such teeth may prove useful for securely anchoring a concrete plug or providing enhanced traction to a tractor device that pushes the bit.

FIGS. 5D-5G show a variety of illustrative transverse cross-sections for a borehole. These cross-sections may be suitable for use in boreholes having a cross-section that is constant or variable along the length of the borehole. FIG. 5D shows an illustrative borehole with a cross-section in the shape of a square having a fin extending from each corner thereby creating the shape of a cross. The fins may prove useful for increasing borehole surface area or maintaining alignment of a steering assembly where very precise steering is desired.

FIG. 5E shows a triangular borehole cross section. Triangles, squares, and other regular polygons offer reduced contact between the drillstring and the borehole wall with a tradeoff between the number and depth of the corners in the cross-section. The contact (and drag) on the drillstring can be made fairly independent of drillstring position if the cross-section turns along the length of the borehole to form a helix much like the threads on a bolt. For example, the bit could be turned 1-3° for each inch of forward progress to provide a thread pitch in the range of one turn every 10-30 feet. Shallower pitches are also envisioned, up to one turn every 0.5 foot, which translates into a turn of 60° for every inch of forward progress. Intermediate turning rates (e.g., 5-10°/in, 12-15°/in, 18-24°/in, and 30-45°/in) may also be acceptable. Such rotation is also applicable to the other cross-sectional shapes and may assist with hole cleaning (i.e., the flushing of debris from the borehole). The wall contact may be further reduced by making the drillstring-contacting portions of the wall convex, as shown in FIG. 5G.

Unprecedented shaping and steering precision may be achievable with the disclosed systems. As previously mentioned, fins or grooves can be cut into the borehole wall and used to minimize rotation and vibration of the bit. In addition, the bottomhole assembly that has been stabilized in this manner can achieve a more precise deviation angle and direction during a geosteering process. The electrodes need not be limited to the bit, but may be spaced in sets along the bottomhole assembly to refine and improve the shape of the borehole to, e.g., to ensure the wellbore is perfectly round or any other desirable shape, and smoothly follows a true centerline without any spiraling or ledging. Moreover, the disclosed systems can be used for "pre-distorting" a borehole in a stressed formation. If the borehole is cut in an elliptical cross-section (see, e.g., FIG. 5F), with the ellipse sized and oriented correctly, the formation will return the borehole to a circular cross-section as the formation relaxes. Consequently, it becomes possible to achieve a borehole with an extremely precise circular (or noncircular) shape and consistently straight over long intervals.

FIG. 6 is a function-block diagram of illustrative drilling system electronics. A pulsed-electric drill bit 602 is driven by a system control center 604 that provides the switching to generate and direct the pulses between electrodes, monitors the electrode temperatures and performance, and otherwise manages the bit operations associated with the drilling process (e.g., creating the desired transient signature of the spark source, modifying the position of movable electrode extensions). System control center 604 is comprised of either a CPU unit or analog electronics designed to carry out these low level operations under control of a data processing unit 606. The data processing unit 606 executes firmware stored in memory 612 to coordinate the operations of the other tool components in response to commands received from the surface systems 610 via the telemetry unit 608, including e.g., reconfiguring the shape of the bit, cutting a core for retrieval, etc.

In addition to receiving commands from the surface systems 610, the data processing unit 606 transmits telemetry information including collected sensor measurements and the measured performance of the drilling system. It is expected that the telemetry unit 608 will communicate with the surface systems via a wireline, optical fiber, or wired drillpipe, but other telemetry methods can also be employed. A data acquisition unit 614 acquires and stores digitized measurements from each of the sensors in a buffer in memory 612.

Data processing unit 606 may perform digital filtering and/or compression before transmitting the measurements to the surface systems 610 via telemetry unit 608. In some embodiments, the data processing unit performs a downhole analysis of the measurements to detect a condition and automatically initiates an action in response to detecting the condition. For example, the data processing unit 606 may be configured to detect a change in rock morphology and may automatically cause sample acquisition unit 616 to cut a core sample for transport to the surface. As another example, the data processing unit 606 may be configured to detect a formation bed boundary and may automatically steer a course parallel or perpendicular to that boundary. In such embodiments, the bottomhole assembly may include a steering mechanism that enables the drilling to progress along a controllable path. The steering mechanism may be integrated into the system control unit 604 and hence operated under control of data processing unit 606.

FIG. 7 is a flowchart of an illustrative drilling method. The method begins in block 702 with the system extending a borehole into a formation using a pulsed-electric drill bit. Generally, this operation occurs when the drill bit is maintained in position at the bottom of a borehole to drive pulses of electrical current into the formation ahead of the bit, thereby detaching material from the formation and extending the borehole. A flow of drilling fluid flushes the detached material from the borehole. In many method embodiments, the bit is not rotated. In other contemplated embodiments, the bit is rotated slowly to create a helix pattern along the length of the borehole.

In block 704, the bottomhole assembly collects logging-while-drilling (LWD) data. Such data may include properties of the formation being penetrated by the borehole (resistivity, density, porosity, etc), environmental properties (pressure, temperature), and measurements regarding the performance of the system (orientation, weight on bit, rate of penetration, etc). In block 706, the system processes the data to determine whether the bit should be reconfigured. Blocks 702-706 are repeated until the system determines that, due to some condition, the operation of the bit should be modified. When the system determines that this is the case, the system adjusts the bit configuration in block 708. Illustrative examples include extending or retracting arms 72 (FIG. 4), performing operations to vary the cross-section of the borehole (FIGS. 5A-5C), cutting a core, or angling the bit for geosteering.

Numerous variations and modifications will become apparent to those skilled in the art once the above disclosure is fully appreciated. For example, the bit can be mounted on a sleeve or a swivel that enables the drillstring to rotate up to hundreds of rotations per minute (RPM) while the bit simply slides without rotation. It is intended that the following claims be interpreted to embrace all such variations and modifications where applicable.

What is claimed is:

1. A method for drilling a noncircular earth borehole, the method comprising:

maintaining a bit in position at a bottom of the noncircular earth borehole without rotating said bit through more than 60° per inch of forward progress, said bit having a noncircular transverse cross-section;

detaching material from the bottom of the noncircular earth borehole with pulses of electrical current; and flushing detached material from the noncircular earth borehole with a flow of drilling fluid.

2. The method of claim 1, wherein said maintaining includes:

adding lengths of tubing to a drillstring to which the bit is mounted;

extending the drillstring into the borehole; and rotating the drillstring during said extending.

3. The method of claim 1, wherein the bit is not rotated more than 15° per inch of forward progress.

4. The method of claim 1, wherein the bit is not rotated more than 3° per inch of forward progress.

5. The method of claim 1, wherein the bit is not systematically rotated.

6. The method of claim 1, wherein the noncircular transverse cross-section is a regular polygon having no more than six sides.

7. The method of claim 1, wherein the noncircular transverse cross-section is finned or star-shaped.

8. The method of claim 1, wherein the noncircular transverse cross-section and noncircular earth borehole cross-section is elliptical.

9. The method of claim 1, further comprising:

varying the transverse cross-section of the bit at different positions in the borehole.

10. The method of claim 1, further comprising cutting a downhole core sample with a square cross-section.

11. A system for drilling a noncircular earth borehole, the system comprising:

a bit that extends the noncircular earth borehole without rotating through more than 60° per inch by detaching formation material with pulses of electric current, said bit having a noncircular cross-section and a plurality of electrodes mounted on the face of said bit; and a drillstring that defines at least one path for a fluid flow to the bit to flush detached formation material from the noncircular earth borehole.

12. The system of claim 11, wherein the bit is substantially non-rotating.

13. The system of claim 11, wherein the noncircular transverse cross-section is a regular polygon having no more than six sides.

14. The system of claim 11, wherein the noncircular transverse cross-section is finned or star-shaped.

15. The system of claim 11, wherein the noncircular transverse cross-section and noncircular earth borehole cross-section is elliptical.

16. The system of claim 11, wherein the bit has extensions that enable the transverse cross-section to be varied at different borehole positions.

17. The system of claim 11, wherein the bit is configured to cut a downhole core sample with a square cross-section.

18. A method for drilling a noncircular earth borehole, the method comprising:

maintaining a bit in position at a bottom of the noncircular earth borehole without rotating said bit through more than 60° per inch of forward progress, said bit having a noncircular transverse cross-section;

driving the bit from within the noncircular earth borehole; and detaching material from the bottom of the noncircular earth borehole with pulses of electrical current.

* * * * *